US006530744B2

(12) United States Patent
Liotta et al.

(10) Patent No.: US 6,530,744 B2
(45) Date of Patent: Mar. 11, 2003

(54) INTEGRAL NOZZLE AND SHROUD

(75) Inventors: Gary Charles Liotta, Beverly, MA (US); Robert Francis Manning, Newburyport, MA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/867,294

(22) Filed: May 29, 2001

(65) Prior Publication Data

US 2002/0182057 A1 Dec. 5, 2002

(51) Int. Cl.[7] ..... F01D 5/14
(52) U.S. Cl. ..... 415/115; 415/189
(58) Field of Search ..... 415/115, 189, 415/191, 210.1, 139

(56) References Cited

U.S. PATENT DOCUMENTS 4,280,792 A 7/1981 Hartel et al.
4,329,113 A 5/1982 Ayache et al.
4,497,610 A 2/1985 Richardson et al.
4,512,715 A 4/1985 Cohn et al.
4,526,226 A 7/1985 Hsia et al.
4,668,162 A 5/1987 Cederwall et al.
5,584,654 A 12/1996 Schaefer et al.
5,669,757 A * 9/1997 Brackett ..... 415/209.2
5,848,854 A * 12/1998 Brackett ..... 403/327
6,142,730 A 11/2000 Tomita et al.
6,146,091 A * 11/2000 Watanabe et al. ..... 415/115
6,155,778 A 12/2000 Lee et al.
6,179,557 B1 * 1/2001 Dodd et al. ..... 415/115
6,183,192 B1 2/2001 Tressler et al.

* cited by examiner

*Primary Examiner*—Edward K. Look
*Assistant Examiner*—James M McAleenan
(74) *Attorney, Agent, or Firm*—Rodney M. Young; Sonnenschein Nath & Rosenthal

(57) ABSTRACT

A gas turbine engine component including a nozzle outer band, a plurality of nozzle vanes extending inward from the outer band, and an inner band extending circumferentially around inner ends of the vanes. Further, the component has a shroud integral with the outer band adapted for surrounding a plurality of blades mounted in the engine for rotation about a centerline thereof.

20 Claims, 3 Drawing Sheets

INTEGRAL NOZZLE AND SHROUD

The United States government may have certain rights in this invention pursuant to Contract No. DAAH-98-C-0023, awarded by the Department of the Army.

BACKGROUND OF THE INVENTION

The present invention relates generally to a gas turbine engine component and more particularly to a nozzle segment having an integral outer band and shroud segment.

Gas turbine engines have a stator and one or more rotors rotatably mounted on the stator. The engines generally include a high pressure compressor for compressing flowpath air traveling through the engine, a combustor downstream from the compressor for heating the compressed air, and a high pressure turbine downstream from the combustor for driving the high pressure compressor. Further, the engines include a low pressure turbine downstream from the high pressure turbine for driving a fan positioned upstream from the high pressure compressor.

Downstream from the combustor, flowpath air temperatures are hot resulting in the components forming the flowpath being hot. As components reach these elevated flowpath air temperatures, their material properties decrease. To combat this reduction in material properties, flowpath air is extracted from cooler areas of the engine such as the compressor and blown through and around the hotter components to lower their temperatures. Delivering cooling air to the hotter components increases their lives, but extracting flowpath air from the cooler areas of the engine reduces the efficiency of the engine. Thus, it is desirable to minimize the amount of cooling air required by the hotter components to increase overall engine efficiency. In particular, it is important to minimize the cooling air introduced downstream from the nozzle throat. Cooling air introduced downstream from the nozzle throat is significantly more detrimental to engine performance than air introduced upstream from the nozzle throat.

FIG. 1 illustrates a conventional high pressure turbine nozzle assembly, designated in its entirety by the reference character 10. The nozzle assembly 10 includes nozzle segments, generally designated by 12, mounted on a nozzle support 14. Shroud segments 16 are mounted on a shroud hanger 18 downstream from the nozzle segments 12. The shroud hanger 18 is mounted on a support 20 surrounding the hanger. The nozzle segments 12 include an outer band segment 22 extending circumferentially around a centerline 24 of the engine having an inner surface 26 forming a portion of an outer flowpath boundary. A plurality of nozzle vanes 28 extend inward from the outer band segment 22 and an inner band segment 30 extends circumferentially around the inner ends of the nozzle vanes. The inner band segment 30 has an outer surface 32 forming a portion of an inner flowpath boundary of the engine. A rotating disk 34 and blades 36 are mounted downstream from the nozzle segments 12 inside the shroud segments 16.

Cooling air is introduced into two cavities 38, 40 positioned outboard from the nozzle outer band segments 22 and the shroud hanger 18, respectively. Part of the cooling air delivered to the cavity 38 outboard from the outer band segments 22 enters passages 42 in the nozzle vanes 28 and exits through cooling holes 44 formed in the surface of the vanes to cool the vanes by film cooling. Some of the cooling air delivered to the cavity 38 leaks into the flowpath between the circumferential ends of the outer band segments 22 and some of the cooling air leaks into the flowpath past a seal 46 positioned between the nozzle outer band segments and the shroud hanger 18. The cooling air delivered to the cavity 40 positioned outboard from the shroud hangers 18 impinges upon the shroud segments 16 to cool them by impingement cooling and then leaks into the flowpath between the circumferential ends of the shroud segments.

SUMMARY OF THE INVENTION

Among the several features of the present invention may be noted the provision of a gas turbine engine component. The component comprises a nozzle outer band extending circumferentially around a centerline of the engine having an inner surface forming a portion of an outer flowpath boundary of the engine. Further, the component includes a plurality of nozzle vanes extending inward from the outer band. Each of the vanes extends generally inward from an outer end mounted on the outer band to an inner end opposite the outer end. In addition, the component comprises an inner band extending circumferentially around the inner ends of the plurality of nozzle vanes having an outer surface forming a portion of an inner flowpath boundary of the engine. Still further, the component includes a shroud integral with the outer band extending circumferentially around the centerline of the engine and having an inner surface forming a portion of the outer flowpath boundary of the engine adapted for surrounding a plurality of blades mounted in the engine for rotation about the centerline thereof.

In another aspect, the present invention includes a high pressure turbine nozzle segment for use in a gas turbine engine. The nozzle segment comprises an outer band segment extending circumferentially around a centerline of the nozzle segment and rearward to a shroud segment integrally formed with the outer band segment extending circumferentially around the centerline. The outer band segment and shroud segment have a substantially continuous and uninterrupted inner surface forming a portion of the outer flowpath boundary of the engine. The nozzle segment also includes nozzle vanes extending inward from the outer band segment. Each of the vanes extends generally radially inward from an outer end mounted on the outer band segment to an inner end opposite the outer end. In addition, the nozzle segment comprises an inner band segment extending circumferentially around the inner ends of the nozzle vanes having an outer surface forming a portion of an inner flowpath boundary of the engine.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
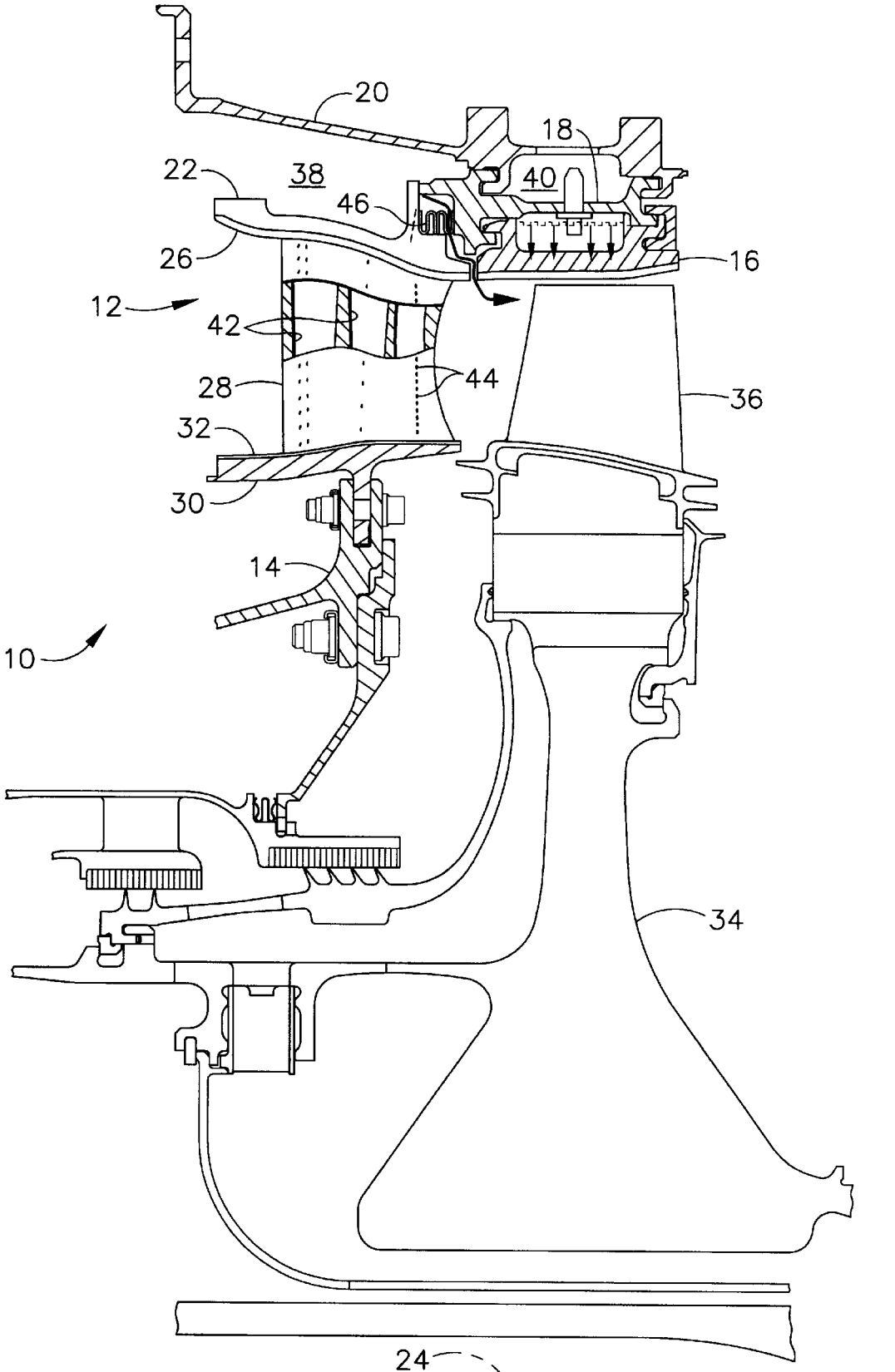
FIG. 1 is a cross section of a conventional high pressure turbine of a gas turbine engine.
Figure 2:
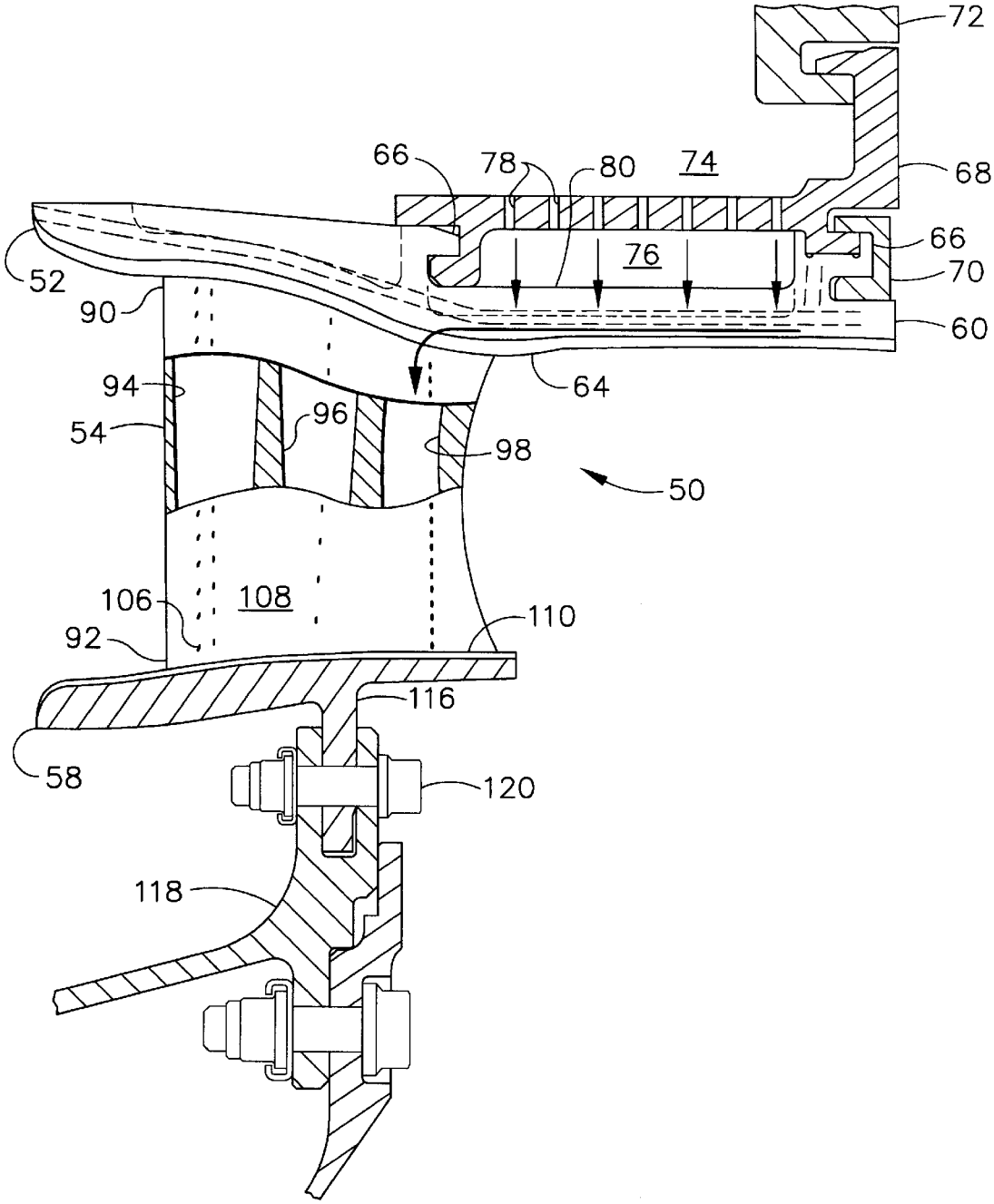
FIG. 2 is a cross section of a nozzle segment and shroud hanger of the present invention.
Figure 3:
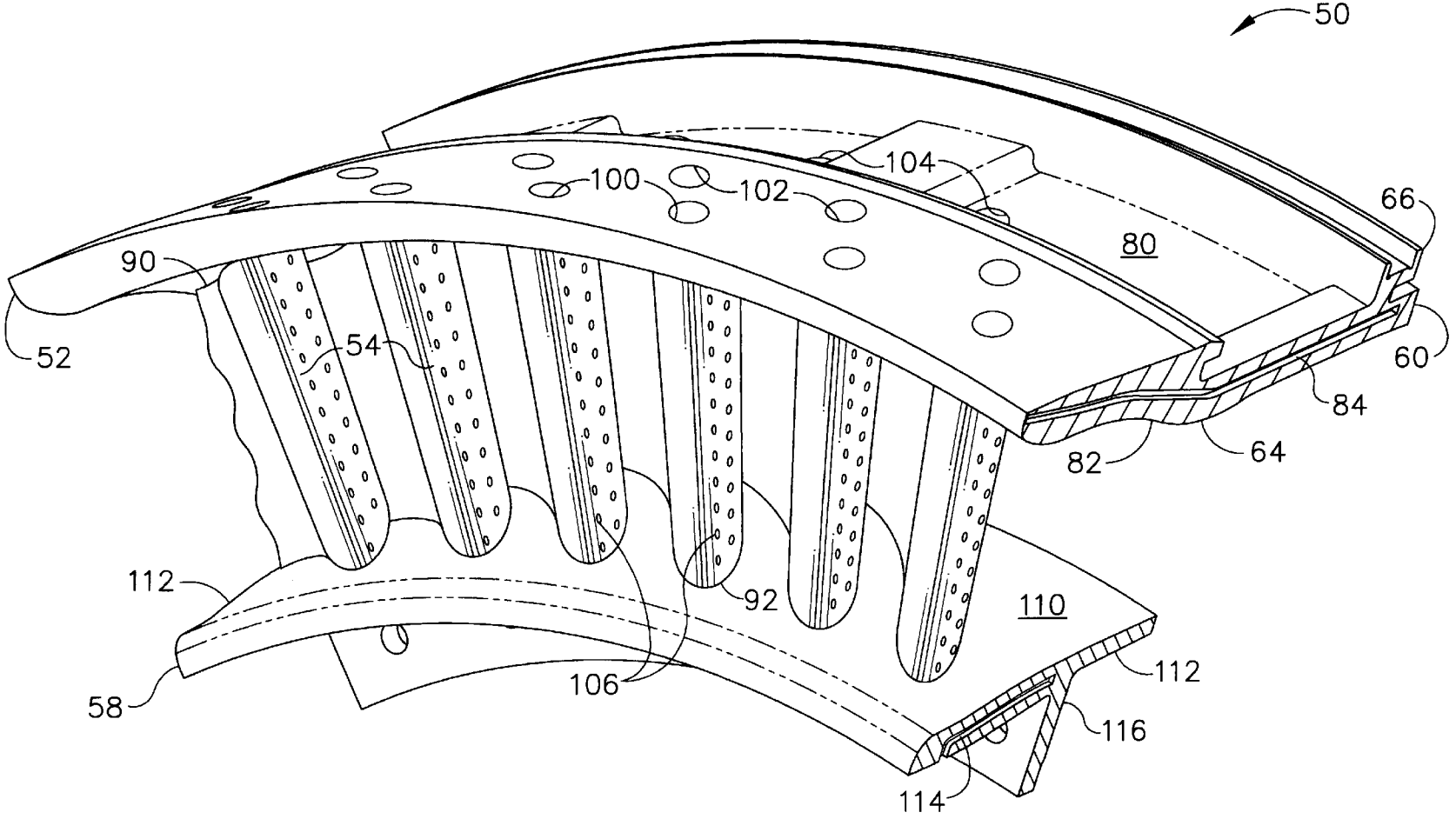
FIG. 3 is a perspective of a nozzle segment of the present invention.

Referring now to the drawings and in particular to FIGS. 2 and 3, a high pressure turbine nozzle segment of the present invention is designated in its entirety by the reference character 50. Although the preferred embodiment is described with respect to a high pressure turbine nozzle segment 50, those skilled in the art will appreciate the present invention may be applied to other components of a gas turbine engine. For example, the present invention may be applied to the low pressure turbine of a gas turbine engine without departing from the scope of the present invention. Further, although the preferred embodiment is described with respect to a segment, those skilled in the art will appreciate the present invention may be applied to unsegmented components extending completely around a centerline 24 (FIG. 1) of the gas turbine engine.

The nozzle segment 50 generally comprises a nozzle outer band segment 52, a plurality of nozzle vanes 54, an inner band segment 58, and a shroud segment 60 integrally formed with the outer band segment. The outer band segment 52 and shroud segment 60 extend circumferentially around the centerline 24 of the engine and have a substantially continuous and uninterrupted inner surface 64 forming a portion of the outer flowpath boundary of the engine. As illustrated in FIG. 2, the nozzle segment 50 is mounted with conventional connectors to a shroud hanger 68 surrounding the shroud segment 60. Although other connectors 66 may be used without departing from the scope of the present invention, in one embodiment the connectors include conventional hook connectors. Conventional C-clips 70 are used to attach the aft connector 66 to the hanger 68.

As further illustrated in FIG. 2, the shroud hanger 68 is mounted inside a conventional shroud support 72 and separates an outer cooling air cavity 74 from an inner cooling air cavity 76. Impingement cooling holes 78 extending through the hanger 68 direct cooling air from the outer cavity 74 into the inner cavity 76 and toward an exterior surface 80 of the shroud segment 60 to cool the shroud segment in a conventional manner. As illustrated in FIG. 3, the circumferential ends 82 of the outer band segment 52 and the shroud segment 60 have one or more grooves 84 which are sized and shaped for receiving conventional spline seals (not shown) to reduce cooling air leakage between the segments. Further, the shroud segment 60 is substantially free of openings extending through the shroud segment from its exterior surface 80 to the inner surface 64.

The vanes 54 extend inward from the outer band 52. Each of these vanes 54 extends generally inward from an outer end 90 mounted on the outer band 52 to an inner end 92 opposite the outer end. Each vane 54 has an airfoil-shaped cross section for directing air flowing through the flowpath of the engine. The vanes 54 include interior passages 94, 96, 98. The passages 94, 96, 98 extend from inlets 100, 102, 104 (FIG. 3) to openings 106 (FIG. 3) in an exterior surface 108 of the vane 54 for conveying cooling air from the inlets to the openings. As will be appreciated by those skilled in the art, the forward and middle passages 94, 96, respectively, receive cooling air from the outer cavity 74, and the rearward passage 98 receives cooling air from the inner cavity 76 after that air impinges on the exterior surface 80 of the shroud segment 60. Although the shroud segment 60 of the embodiment described above is positioned downstream from the nozzle vanes 54 when the component is mounted in the engine so it surrounds a row of blades 36 (FIG. 1) mounted downstream from the vanes, it is envisioned the integral shroud segment may be positioned upstream from the vanes so it surrounds a row of blades upstream from the vanes without departing from the scope of the present invention.

The inner band segment 58 extends circumferentially around the inner ends 92 of the vanes 54 and has an outer surface 110 forming a portion of an inner flowpath boundary of the engine. As with the outer band segment 52 and shroud segment 60, the circumferential ends 112 of the inner band segment 58 have grooves 114 which are sized and shaped for receiving a conventional spline seal (not shown) to prevent leakage between the inner band segments. A flange 116 extends inward from the inner band segment 58 for connecting the nozzle segment 50 to a conventional nozzle support 118 with fasteners 120.

Although the gas turbine engine component of the present invention may be made in other ways without departing from the scope of the present invention, in one embodiment the outer band segment 52, vanes 54, inner band segment 58 and shroud segment 60 are cast as one piece. After casting, various portions of the component are machined to final component dimensions using conventional machining techniques.

As will be appreciated by those skilled in the art, the high pressure turbine nozzle segment 50 of the present invention has fewer leakage paths for cooling air than conventional nozzle assemblies. Rather than having a gap and potentially significant cooling air leakage between the outer band segment and the shroud segment, the nozzle segment 50 of the present invention has an integral outer band segment 52 and shroud segment 60. Further, rather than allowing all of the cooling air which impinges on the exterior surface of the shroud segment to leak directly into the flowpath, the nozzle segment 50 of the present invention directs much of the cooling air impinging on the exterior surface 80 of the shroud segment 60 through cooling air passages 98 extending through the vanes 54 and out through film cooling openings 106 on the exterior surface 108 of the vanes. The air used to cool the shrouds 76 also cools the nozzle 54 and discharges through the openings 106 which are positioned upstream from the nozzle throat. Because the openings 106 are positioned upstream from the nozzle throat, the nozzle segment 50 of the present invention has better performance than conventional nozzle assemblies 10 which discharge the cooling air downstream from the nozzle throat. Thus, as will be appreciated by those skilled in the art, the high pressure turbine nozzle segment 50 of the present invention requires less cooling air than a conventional nozzle assembly 10, allowing cooling air to be directed to other areas of the engine where needed and/or allowing overall engine efficiency to be increased.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. In combination, a gas turbine engine component comprising:

a nozzle outer band extending circumferentially around a centerline of the engine having an inner surface forming a portion of an outer flowpath boundary of the engine;

a plurality of nozzle vanes extending inward from the outer band, each of said vanes extending generally inward from an outer end mounted on the outer band to an inner end opposite said outer end;

an inner band extending circumferentially around the inner ends of said plurality of nozzle vanes having an outer surface forming a portion of an inner flowpath boundary of the engine; and a shroud integral with the outer band extending circumferentially around the centerline of the engine and having an inner surface forming a portion of the outer flowpath boundary of the engine adapted for surrounding a plurality of blades mounted in the engine for rotation about the centerline thereof; and a hanger mounted outside the shroud for directing cooling air toward an exterior surface of the shroud adapted for surrounding the plurality of blades.

2. A component as set forth in claim 1 wherein said plurality of nozzle vanes are turbine nozzle vanes.

3. A component as set forth in claim 1 wherein the shroud is positioned aft of the nozzle vanes when the component is mounted in the engine.

4. A component as set forth in claim 1 wherein each of said plurality of nozzle vanes is a cooled vane having an interior passage extending from an inlet to an opening in an exterior surface of the vane for conveying cooling air from the inlet to the opening.

5. A component as set forth in claim 4 wherein cooling air flows over the shroud to cool the shroud.

6. A component as set forth in claim 5 wherein said cooling air flowing over the shroud is directed through the interior passage in the vane.

7. A component as set forth in claim 1 wherein the inner band is segmented.

8. A component as set forth in claim 7 wherein the outer band and shroud are segmented.

9. A high pressure turbine nozzle segment for use in a gas turbine engine, said segment comprising:

an outer band segment extending circumferentially around a centerline of the nozzle segment and rearward to a shroud segment integrally formed with the outer band segment extending circumferentially around the centerline, said outer band segment and shroud segment having a substantially continuous and uninterrupted inner surface forming a portion of the outer flowpath boundary of the engine;

a plurality of cooled nozzle vanes extending inward from the outer band segment, each of said vanes extending generally radially inward from an outer end mounted on the outer band segment to an inner end opposite said outer end and having an interior passage extending through the vane for conveying cooling air; and an inner band segment extending circumferentially around the inner ends of said plurality of nozzle vanes having an outer surface forming a portion of an inner flowpath boundary of the engine;

wherein the shroud and outer band are configured so that cooling air flowing over the shroud to cool the shroud surrounding the plurality of blades enters the interior passage extending through the vane to cool the vane.

10. A nozzle segment as set forth in claim 9 wherein at least one of the outer band segment and the shroud segment includes a connector for mounting the nozzle segment and shroud segment in the engine.

11. A nozzle segment as set forth in claim 10 wherein the connector is a hook.

12. A nozzle segment as set forth in claim 9 wherein each circumferential end of the outer band segment, the shroud segment and the inner band segment has a groove sized and shaped for receiving a spline seal.

13. A nozzle segment as set forth in claim 9 wherein the shroud segment is substantially free of openings extending through the shroud segment from an outer surface to the inner surface.

14. A nozzle segment as set forth in claim 9 in combination with a hanger mounted outside the shroud segment for impinging cooling air on an exterior surface of the shroud segment.

15. A gas turbine engine component comprising:

a nozzle outer band extending circumferentially around a centerline of the engine having an inner surface forming a portion of an outer flowpath boundary of the engine;

a plurality of cooled nozzle vanes extending inward from the outer band, each of said vanes extending generally inward from an outer end mounted on the outer band to an inner end opposite said outer end and having an interior passage extending through the vane for conveying cooling air;

an inner band extending circumferentially around the inner ends of said plurality of nozzle vanes having an outer surface forming a portion of an inner flowpath boundary of the engine; and a shroud integral with the outer band extending circumferentially around the centerline of the engine and having an inner surface forming a portion of the outer flowpath boundary of the engine adapted for surrounding a plurality of blades mounted in the engine for rotation about the centerline, wherein the shroud and outer band are configured so that cooling air flowing over the shroud to cool the shroud surrounding the plurality of blades enters the interior passage extending through the vane to cool the vane.

16. A component as set forth in claim 15 wherein said plurality of nozzle vanes are turbine nozzle vanes.

17. A component as set forth in claim 15 wherein the shroud is positioned aft of the nozzle vanes when the component is mounted in the engine.

18. A component as set forth in claim 15 in combination with a hanger mounted outside the shroud for directing cooling air toward an exterior surface of the shroud.

19. A component as set forth in claim 15 wherein the inner band is segmented.

20. A component as set forth in claim 19 wherein the outer band and shroud are segmented.

* * * * *